US010138686B2

(12) United States Patent
Zhou

(10) Patent No.: US 10,138,686 B2
(45) Date of Patent: Nov. 27, 2018

(54) DOWNHOLE SELF-ISOLATING WELLBORE DRILLING SYSTEMS

(71) Applicant: Saudi Arabian Oil Company, Dhahran (SA)

(72) Inventor: Shaohua Zhou, Dhahran Hills (SA)

(73) Assignee: Saudi Arabian Oil Company, Dhahran (SA)

( * ) Notice: Subject to any disclaimer, the term of this patent is extended or adjusted under 35 U.S.C. 154(b) by 224 days.

(21) Appl. No.: 15/379,156

(22) Filed: Dec. 14, 2016

(65) Prior Publication Data

US 2017/0089148 A1 Mar. 30, 2017

Related U.S. Application Data

(62) Division of application No. 14/177,423, filed on Feb. 11, 2014, now Pat. No. 9,611,700.

(51) Int. Cl.

| | |
|---|---|
| ***E21B 21/08*** | (2006.01) |
| ***E21B 34/08*** | (2006.01) |
| ***E21B 12/00*** | (2006.01) |
| ***E21B 4/02*** | (2006.01) |
| ***E21B 33/128*** | (2006.01) |

(Continued)

(52) U.S. Cl.

CPC ..... *E21B 12/00* (2013.01); *E21B 4/02* (2013.01); *E21B 7/00* (2013.01); *E21B 21/08* (2013.01); *E21B 21/10* (2013.01); *E21B 33/12* (2013.01); *E21B 33/1285* (2013.01); *E21B 34/08* (2013.01); *E21B 17/1078* (2013.01);

(Continued)

(58) Field of Classification Search

CPC ..... E21B 12/06; E21B 21/08; E21B 21/002; E21B 43/34; E21B 43/38; E21B 34/08; E21B 17/006

See application file for complete search history.

(56) References Cited

U.S. PATENT DOCUMENTS

| | | |
|---|---|---|
| 2,945,541 A | 7/1969 | Maly et al. |
| 4,373,592 A | 2/1983 | Dellinger et al. |

(Continued)

FOREIGN PATENT DOCUMENTS

| | | |
|---|---|---|
| CN | 1506602 | 6/2004 |
| CN | 101379269 | 3/2009 |

(Continued)

OTHER PUBLICATIONS

Chinese Office Action in Chinese Application No. 201580016356.7, dated Jan. 26, 2018, 27 pages.

(Continued)

*Primary Examiner* — Kenneth L Thompson

(74) *Attorney, Agent, or Firm* — Fish & Richardson P.C.

(57) ABSTRACT

One example of a downhole self-isolating wellbore drilling system to pulverize formation cuttings includes a cutting grinder tool and an isolation tool. The cutting grinder tool can be attached to a drill string uphole relative to a drill bit attached to a downhole end of the drill string. The cutting grinder tool can receive and pulverize formation cuttings resulting from drilling a formation using the drill bit. The isolation tool can be attached to the drill string uphole relative to the cutting grinder tool. The isolation tool can control flow of the pulverized formation cuttings mixed with a drilling mud uphole through the drill string.

19 Claims, 9 Drawing Sheets

(51) Int. Cl.

| | |
|---|---|
| ***E21B 7/00*** | (2006.01) |
| ***E21B 33/12*** | (2006.01) |
| ***E21B 21/10*** | (2006.01) |
| *E21B 17/10* | (2006.01) |
| *E21B 49/08* | (2006.01) |
| *E21B 34/00* | (2006.01) |

(52) U.S. Cl.
CPC ..... *E21B 49/08* (2013.01); *E21B 2034/002* (2013.01); *E21B 2034/007* (2013.01)

(56) References Cited

U.S. PATENT DOCUMENTS

| | | | | |
|---|---|---|---|---|
| 4,754,819 | A | 7/1988 | Dellinger | |
| 5,803,178 | A | 9/1998 | Cain | |
| 5,901,797 | A | 5/1999 | Hansen et al. | |
| 6,481,501 | B2 | 11/2002 | Chavez | |
| 6,988,557 | B2 | 1/2006 | Whanger et al. | |
| 6,997,272 | B2 | 2/2006 | Eppink | |
| 7,174,975 | B2 | 2/2007 | Krueger et al. | |
| 7,228,915 | B2 | 6/2007 | Thomson | |
| 7,631,695 | B2 | 12/2009 | Schafer et al. | |
| RE41,118 | E | 2/2010 | Brezinski et al. | |
| 7,942,199 | B2 | 5/2011 | Angman | |
| 8,225,880 | B2 | 7/2012 | Rytlewski et al. | |
| 8,511,402 | B2 | 8/2013 | Hariharan et al. | |
| 9,022,146 | B2 | 5/2015 | Krueger | |
| 9,611,700 | B2 * | 4/2017 | Zhou | E21B 7/00 |
| 2005/0098349 | A1 | 5/2005 | Krueger et al. | |
| 2010/0314134 | A1 | 12/2010 | Nutley et al. | |
| 2011/0203848 | A1 | 8/2011 | Krueger et al. | |
| 2015/0240567 | A1 | 8/2015 | Grable | |
| 2017/0089147 | A1 * | 3/2017 | Zhou | E21B 7/00 |
| 2017/0096860 | A1 * | 4/2017 | Zhou | E21B 7/00 |

FOREIGN PATENT DOCUMENTS

| | | | |
|---|---|---|---|
| GB | 2088440 | A | 6/1982 |
| WO | WO2007126833 | A1 | 11/2007 |

OTHER PUBLICATIONS

International Search Report and Written Opinion of the International Searching Authority issued in International Application No. PCT/US2015/015016 dated Jun. 2, 2015; 11 pages.

* cited by examiner

DOWNHOLE SELF-ISOLATING WELLBORE DRILLING SYSTEMS

CROSS-REFERENCE TO RELATED APPLICATIONS

This application is a divisional application of, and claims priority to, U.S. patent application Ser. No. 14/177,423, entitled "Downhole Self-Isolating Wellbore Drilling Systems", which was filed on Feb. 11, 2014, now U.S. Pat. No. 9,611,700, the disclosure of which is incorporated herein by reference in its entirety.

TECHNICAL FIELD

This disclosure relates to wellbore drilling.

BACKGROUND

In wellbore drilling, a drill bit is attached to a drill string, lowered into a well, and rotated in contact with a formation. The rotation of the drill bit breaks and fractures the formation forming a wellbore. A drilling fluid (also known as drilling mud) is circulated down the drill string and through nozzles provided in the drill bit to the bottom of the wellbore, and then upward toward the surface through an annulus formed between the drill string and the wall of the wellbore. The drilling fluid serves many purposes including cooling the drill bit, supplying hydrostatic pressure upon the formation penetrated by the wellbore to prevent fluids from flowing into the wellbore, reducing torque and drag between the drill string and the wellbore, carrying the formation cuttings, i.e., the portions of the formation that are fractured by the rotating drill bit, to the surface, and other purposes.

One potential issue during wellbore drilling operations occurs when hydrocarbons from the formation being drilled are released into the wellbore before the well is set for production. The hydrocarbons in the formation, which can be at pressures greater than the drilling mud weight on the drill bit, can flow to the surface resulting in well blowout. Another potential issue during wellbore drilling occurs due to the aggregation of formation cuttings, either downhole or at other positions along the flow path of the drilling mud. Such aggregation can, among other issues, reduce a life of the drill bit, decrease penetration rate, and result in stuck pipe and/or lost circulation.

SUMMARY

This disclosure describes downhole self-isolating wellbore drilling systems to pulverize formation cuttings.

In general, one innovative aspect of the subject matter described here can be implemented as a wellbore drilling system. A cutting grinder tool is attached to a drill string uphole relative to a drill bit attached to a downhole end of the drill string. The cutting grinder tool can receive and pulverize formation cuttings resulting from drilling a formation using the drill bit. An isolation tool is attached to the drill string uphole relative to the cutting grinder tool. The isolation tool can control flow of the pulverized formation cuttings mixed with a drilling mud through the drill string.

This, and other aspects, can include one or more of the following features. A mud motor can be positioned in the drill string between the cutting grinder tool and the isolation tool. The mud motor can vary a rotational speed of the drill bit. The isolation tool can include an elastomer that expands in response to being contacted with hydrocarbons. The isolation tool can at least partially block flow of the mixture in response to the elastomer expanding. The isolation tool can include a floating member having a density that is greater than a density of the mixture that includes hydrocarbons and lesser than a density of the mixture that excludes hydrocarbons. The isolation tool can include a flow path including a seat to receive or release the floating member in response to a change in the density the mixture. The isolation tool can at least partially block or at least partially permit flow of the mixture in response to the flow path being at least partially closed or at least partially open, respectively, in response to receiving or releasing the floating member, respectively, in the seat.

The isolation tool can include a first unidirectional flow and a second direction of flow positioned at an inlet and an outlet, respectively, to the flow path. Each of the first unidirectional flow and the second unidirectional flow can open or close in response to the floating member be received in or released from the seat, respectively. The isolation tool can include a bypass flow path in response to the flow path being closed. A stabilizer can surround the cutting grinder tool. An outer diameter of the cutting grinder tool surrounded by the stabilizer can be substantially equal to an outer diameter of the drill bit. The cutting grinder tool can be positioned over the drill bit to receive the formation cuttings. An outer diameter of the isolation tool can be substantially equal to the outer diameter of the cutting grinder tool surrounded by the stabilizer. The isolation tool can be positioned over the drill bit to receive the pulverized formation cuttings from the cutting grinder tool. The cutting grinder tool can include a stationary outer housing and a rotating inner housing defining inlet portions to receive the formation cuttings. Grinding members can be connected to the rotating inner housing. The grinding members and the rotating inner housing can rotate to pulverize the formation cuttings received through the inlet portions.

Another innovative aspect of the subject matter described here can be implemented as a method. Formation cuttings resulting from drilling a formation using a drill bit attached to a downhole end of a drill string are received. The formation cuttings are mixed with drilling mud flowed through the drill string. The received formation cuttings are pulverized resulting in a mixture of pulverized formation cuttings and the drilling mud. The flow of the mixture of the pulverized formation cuttings and the drilling mud is controlled based on a presence of hydrocarbons released from the formation in the mixture.

This, and other aspects, can include one or more of the following features. Controlling the flow of the mixture based on the presence of the hydrocarbons can include determining a presence of the hydrocarbons released from the formation in the mixture, and at least partially blocking the flow of the mixture towards a surface in response to determining the presence. To at least partially block the flow of the mixture, an elastomer in a flow path of the mixture can be expanded in response to determining the presence of the hydrocarbons. The expanded elastomer can at least partially block the flow of the mixture through the flow path. To at least partially block the flow of the mixture, a floating member can be received in a seat formed in a flow path of the mixture in response to a density of the floating member being greater than a density of the mixture that includes the hydrocarbons. The floating member seated in the seat can at least partially block the flow of the mixture through the flow path.

To pulverize the received formation cuttings resulting in the mixture of pulverized formation cuttings and the drilling mud, the formation cuttings can be received in inlet portions defined by a stationary outer housing and a rotating inner housing of a cutting grinder tool attached to the drill string and the positioned above the drill bit. The cutting grinder tool can include grinding members connected to the rotating inner housing. The rotating inner housing can be rotated to pulverize the formation cuttings received through the inlet portions. The mixture of the pulverized formation cuttings and the drilling might can be flowed from a cutting grinder tool that pulverizes the received formation cuttings to an isolation tool that controls the flow of the mixture.

A further innovative aspect of the subject matter described here can be implemented as a wellbore drilling system. A cutting grinder tool is attached to a drill string about a drill bit attached to the drill string. The cutting grinder tool includes a grinder tool outer housing and a grinder tool inner housing defining a cutting grinder tool inlet portion to receive formation cuttings resulting from drilling a formation using the drill bit, and grinding members positioned between the grinder tool outer housing and the grinder tool inner housing to pulverize the received formation cuttings. An isolation tool is attached to the drill string above the cutting grinder tool. The isolation tool includes an isolation tool outer housing and an isolation tool the inner housing defining and isolation tool inlet portion to receive a mixture including the formation cuttings pulverized by the cutting grinder tool and drilling mud. The isolation tool includes a flow control system to control a flow of the mixture based on a presence of hydrocarbons in the mixture.

This, and other aspects, can include one or more of the following features. A stabilizer can surround the grinder to outer housing. An outer diameter of the grinder tool outer housing surrounded by the stabilizer can be substantially equal to an outer diameter of the drill bit to receive the formation cuttings carried by the drilling mud through the inlet portions. The grinder tool inner housing can rotate. The grinding members can be attached to the grinder tool inner housing to rotate to pulverize the formation cuttings. The flow control system can include an elastomer to expand in the presence of hydrocarbons. The flow control system can at least partially block the flow of the pulverized formation cuttings in the drilling mud in response to expansion of the elastomer. The flow control system can include a floating member, and a seat to receive the floating member in response to a density of the floating member being greater than a density of the mixture including hydrocarbons. The flow control system can at least partially block the flow of the pulverized formation cuttings in the drilling mud in response to the floating member being received in the seat.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a downhole wellbore drilling system which includes two tool components, namely, a cutting grinder tool and an isolation tool. The cutting grinder tool can pulverize formation cuttings, which result from drilling a wellbore in a formation using a drill bit, into slutty. The isolation tool can pack off the tool internally, i.e., block the flow of the fluid circulating path. As described below, the cutting grinder tool is positioned above the drill bit and the isolation tool is positioned above the cutting grinder tool. The isolation tool can be implemented in different ways, e.g., using fast acting oil/gas elastomers that activate to pack off the tool internally, a mechanical shutoff device that includes a density-sensitive ball operating mechanism.

By implementing the downhole wellbore drilling system described here, the drilling system can proactively limit and substantially reduce the risk of uncontrolled hydrocarbon influx in an automatic manner. The tools described here can be implemented to be simple and robust, thereby decreasing cost to manufacture the tools. In some implementations, the isolation tool can capture hydrocarbon sample during a hydrocarbon influx event. Such samples can be analyzed to determine the properties of the hydrocarbons in the formation being drilled using the drilling system. The drilling system described here may not rely solely on measurement while drilling (MWD) or logging while drilling (LWD) systems to detect hydrocarbon influx. In the absence of hydrocarbon influx, the drilling system described here can function like a drilling bottom hole assembly (BHA) to allow both drilling and circulation of pulverized formation cuttings with the benefit of improving wellbore cleaning and decreasing a risk of the tools string sticking. In this manner, the downhole wellbore drilling system can increase safety of the wellbore drilling operations.

Figure 1:
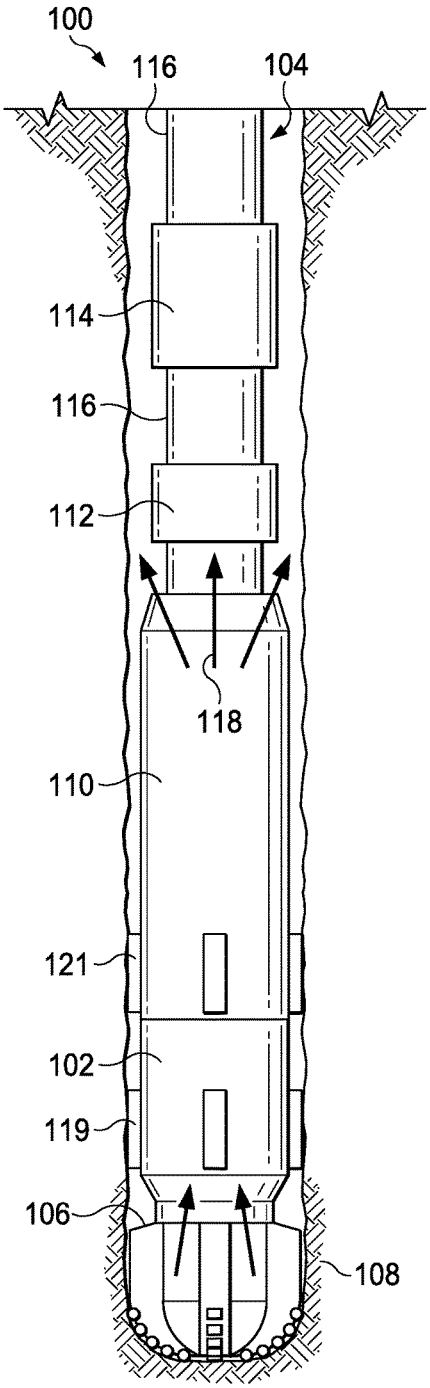
FIG. 1 is a schematic diagram showing an example downhole self-isolating wellbore drilling system.

FIG. 1 is a schematic diagram showing an example downhole self-isolating wellbore drilling system 100. The drilling system 100 includes a cutting grinder tool 102 to be attached to a drill string 104 uphole relative to a drill bit 106 attached to a downhole end of the drill string 104. The drilling system 100 includes an isolation tool 110 to be attached to the drill string 104 uphole relative to the cutting grinder tool 102. The cutting grinder tool 102 can receive and pulverize formation cuttings (not shown) resulting from drilling a formation 108 using the drill bit 106. The isolation tool 110 can control flow of the pulverized formation cuttings mixed with a drilling mud 118 uphole toward a surface of the wellbore. The drilling system 100 can additionally include wellbore drilling elements such as a circulating sub 112 positioned uphole relative to the isolation tool 110, a drilling jar 114 positioned uphole relative to the circulating sub 112, drill collars 116 attached to either ends of the drilling jar 114, and other wellbore drilling elements.

Figure 2:
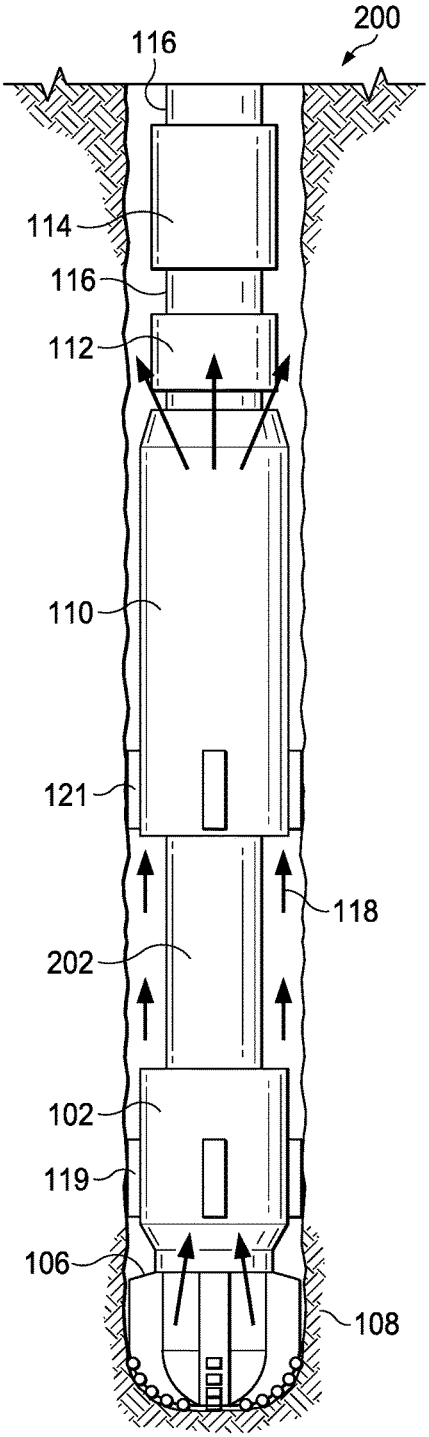
FIG. 2 is a schematic diagram showing the example downhole self-isolating wellbore drilling system of FIG. 1 including a mud motor.

FIG. 2 is a schematic diagram showing the example downhole self-isolating wellbore drilling system of FIG. 1 including a mud motor 202. In some implementations, the cutting grinder tool 102 can be attached to the drill string 104 above, e.g., immediately above, the drill bit 106. The isolation tool 110 can be attached to the drill string 104 above, e.g., immediately above, the cutting grinder tool 102, as shown in FIG. 1. The pressure of the mud pump can pump the drilling mud carrying the formation cuttings to the cutting grinder tool 102. Similarly, the pressure can pump the drilling mud carrying the pulverized formation cuttings from the cutting grinder tool 102 to the isolation tool 110. Alternatively, or in addition, as shown in FIG. 2, the mud motor 202 can be attached to the drill string 104 between the cutting grinder tool 102 and the isolation tool 110. The mud motor 202 can pump a mixture of the formation cuttings pulverized by the cutting grinder tool 102 and the drilling mud uphole toward the isolation tool 110. Alternatively, or in addition, the mud motor 202 can increase a rotational speed of the drill bit 106.

Figure 3A:
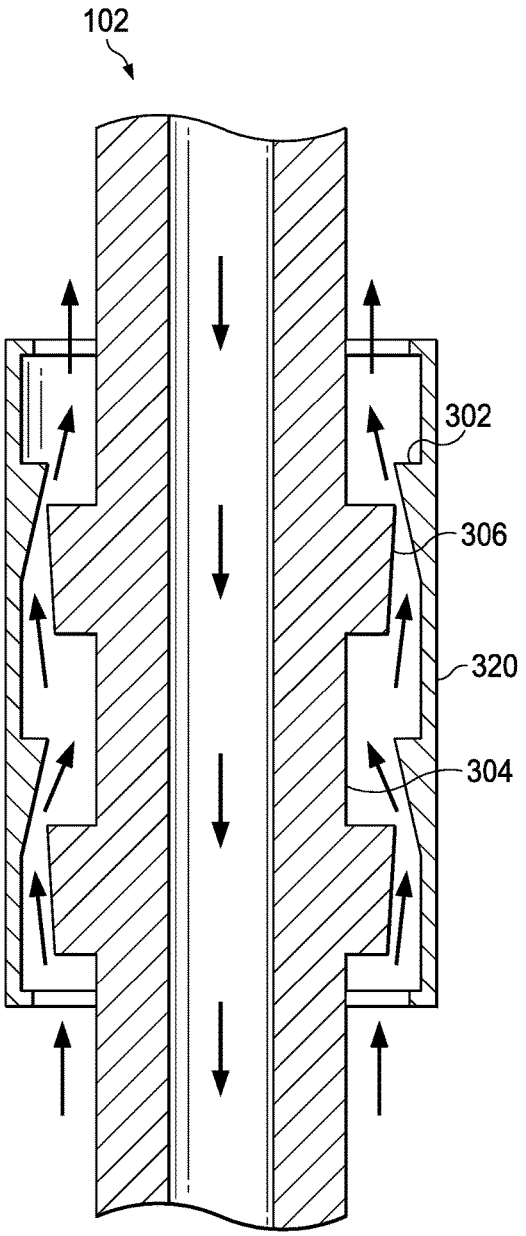
FIGS. 3A-3C are schematic diagrams showing different views of a cutting grinder tool to pulverize formation cuttings.
Figure 3B:
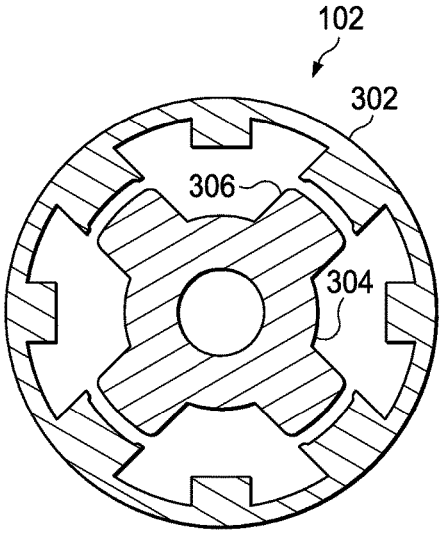
Figure 3C:
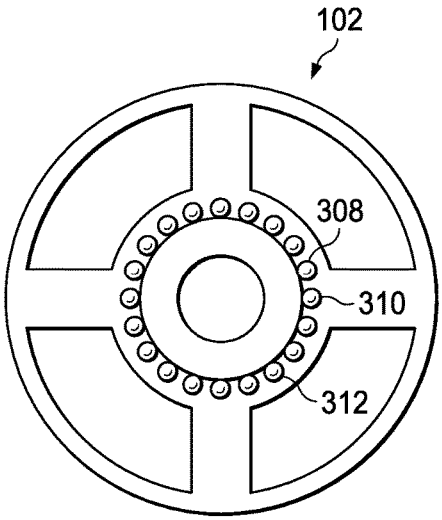

FIGS. 3A-3C are schematic diagrams showing different views of a cutting grinder tool 102 to pulverize formation cuttings. FIG. 3A is a cross-sectional view of the cutting grinder tool 102. The cutting grinder tool 102 includes a stationary outer housing 302 and a rotating inner housing 304 which define inlet portions 320 to receive the formation cuttings carried by the drilling mud uphole toward the surface of the wellbore. The cutting grinder tool 102 also includes grinding members 306 (e.g., rock cutting edges) connected to the rotating inner housing 304. FIG. 3B is a bottom inlet or top outlet cross section view of the cutting grinder tool 102 showing an arrangement of the grinding members 306 between the stationary outer housing 302 and the rotating inner housing 304. In some implementations, the grinding members 306 may not overlap each other or may only partially overlap each other, thereby resulting in a lower pressure drop across the cutting grinder tool 102 relative to a design in which the grinding members 306 overlap. FIG. 3C is another top view of the cutting grinder tool 102 showing bearings (e.g., a first ball bearing 308, a second ball bearing 310, a third ball bearing 312, and other bearings) that allow the inner housing 304 to rotate about an axis of the drill string 104.

In some implementations, a full gauge solid stabilizer 119 is positioned in the wellbore surrounding the cutting grinder tool 102. An outer diameter of the cutting grinder tool 102 can be less than an outer diameter of the drill bit 106. For example, a nominal outer diameter of the cutting grinder tool 102 is typically ⅛" under-gauge or smaller than an outer diameter of the drill bit 106. An outer diameter of the cutting grinder tool 102 surrounded by the stabilizer 119 can be substantially the same as the outer diameter of the drill bit 106. For example, an outer diameter of the stationary outer housing 302 surrounded by the stabilizer 119 can be equal to the outer diameter of the drill bit 106. Alternatively, the outer diameter of the stationary outer housing 302 surrounded by the stabilizer 119 can be substantially the same as the outer diameter of the drill bit 106.

Because the cutting grinder tool 102 is positioned immediately above the drill bit 106, the cutting grinder tool 102 can divert nearly all of the mixture of the drilling mud and the formation cuttings into the internal flow passages defined between the outer housing 302 and the inner housing 304. In some implementations, the cutting grinder tool 102 includes full gauge solid stabilizer 119 to divert returned drilling mud flow into the tool.

In operation, the drilling mud is flowed from the surface of the wellbore by pressure created by a mud pump at the surface. The drilling mud flows through an internal flow path in the drill string 104 and out of ports in the drill bit 106, and carries the formation cuttings into the inlet portions 320 of the cutting grinder tool 102. As the inner housing 304 rotates with the drill string 104 (e.g., due to a connection with the drill string 104), the grinding members 306 rotate with the inner housing 304 to pulverize the formation cuttings (e.g., crush into pieces smaller than the formation cuttings) before being flowed out of the cutting grinder tool 102 toward the isolation tool 110. For example, the cutting grinder tool 102 can pulverize the formation cuttings to a size that is sufficiently small to avoid clogging the flow paths in the isolation tool 110 (described below). In some implementations, the mud motor 202 can be used to increase drill bit rotating speed for the purpose of fast drilling rate. In such implementations, the mud motor 202 can also turn the inner housing 304 faster to pulverize formation cuttings pumped towards the isolation tool 110.

In some situations, a quantity of formation cuttings that the cutting grinder tool 102 pulverizes can cause an increase in the hydraulic pressure on the mud pump that pumps the drilling mud through the drilling system 100. However, the concentration of solids mixed with the drilling fluid (e.g., the formation cuttings, bridging material mixed at the surface for pumping the drilling mud, other solids) is small (e.g., in the order of 3% to 5% of the total circulating drilling mud volume). This is particularly true when drilling penetration rate is slow to very slow in hard rock. Consequently, the operation of the cutting grinder tool 102 is not likely to create a significant pressure buildup at the mud pump or to have a significant effect on the drilling hydraulics of the drilling system 100.

FIGS. 4A-4E are schematic diagrams showing different views of a first implementation of an isolation tool 102 to isolate the wellbore drilling system. In some situations, hydrocarbons can be released from the formation due to the drilling resulting in the mixture including drilling mud, pulverized formation cuttings and the released hydrocarbons. As described above, the release of the hydrocarbons can pose a safety hazard, e.g., a possible well blow out. The isolation tool 102 can be operated to pack off the wellbore internally to prevent further release of the hydrocarbons by isolating the drilling system 100, as described below.

Figure 4A:
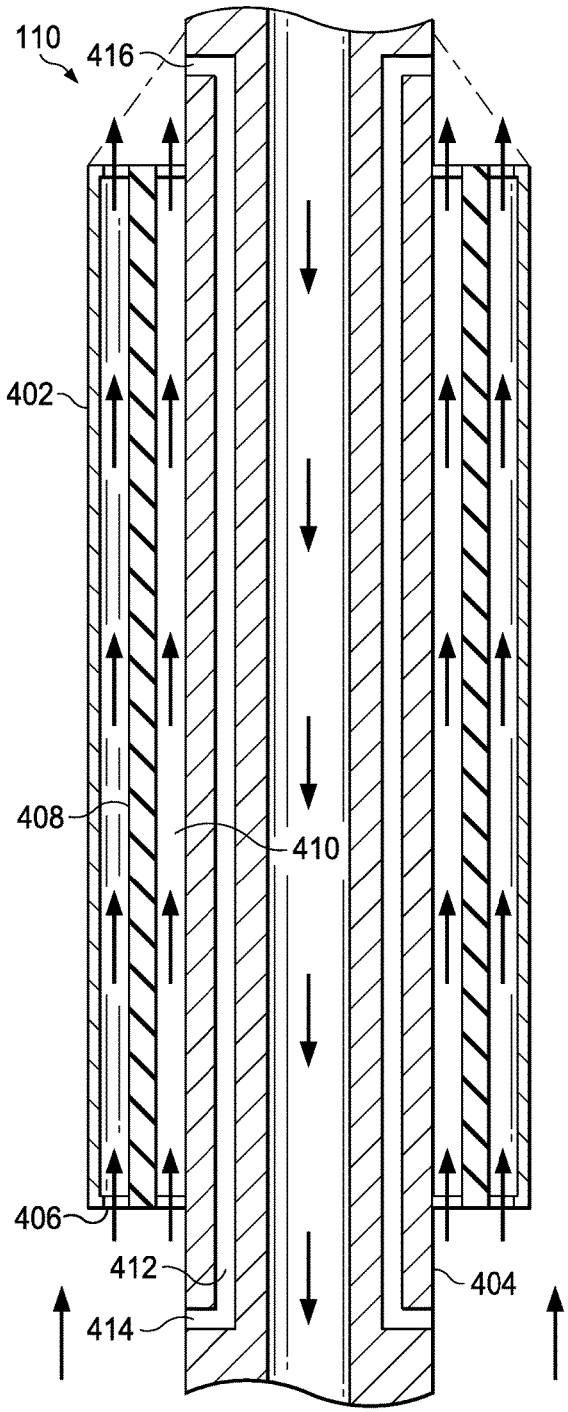
FIGS. 4A-4E are schematic diagrams showing different views of a first implementation of an isolation tool to isolate the wellbore drilling system.

FIG. 4A is a cross-sectional view of a first implementation of the isolation tool 102. The isolation tool 110 includes a stationary outer housing 402 and a rotary inner housing 404 that define inlet portions 406, a flow path 410 through which the mixture of the drilling mud and pulverized formation cuttings can flow through the isolation tool 110, and outlet portions 416 through which the mixture can exit the isolation tool 110 and flow to the surface of the wellbore.

In some implementations, a full gauge solid stabilizer 121 is positioned surrounding the isolation tool. An outer diameter of the isolation tool 110 surrounded by the stabilizer 121 substantially the same as an outer diameter of the cutting grinder tool 102 surrounded by the stabilizer 119. For example, an outer diameter of the stationary outer housing 402 surrounded by the stabilizer 121 can be equal to the outer diameter of the stationary outer housing 402 surrounded by the stabilizer 121. Alternatively, the outer diameter of the stationary outer housing 402 surrounded by the stabilizer 121 can be substantially the same as the outer diameter of the stationary outer housing 302 surrounded by the stabilizer 119. For example, a nominal outer diameter of the isolation tool 110 is same as the cutting grinder tool 102 with a full gauge solid stabilizer 119. Because the isolation tool 110 is positioned immediately above the cutting grinder tool 102, the isolation tool 110 diverts nearly all of the mixture of the drilling mud and the pulverized formation cuttings into the flow path 410. The isolation tool 110 can also include a bypass flow path 412 with an inlet 414 that can be closed when the mixture flows through the isolation tool 110 and that can be opened in response to the flow path 410 being blocked.

Figure 4B:
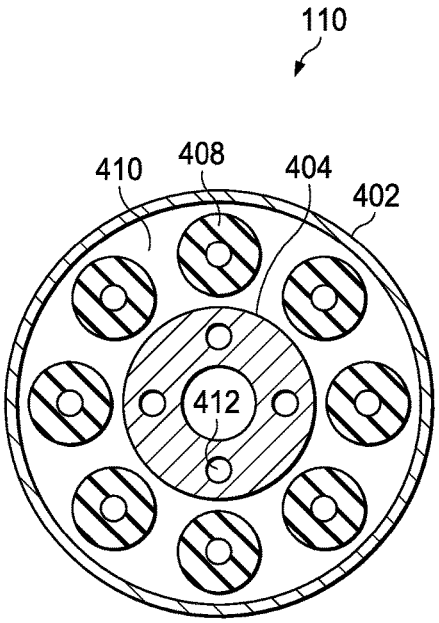
Figure 4C:
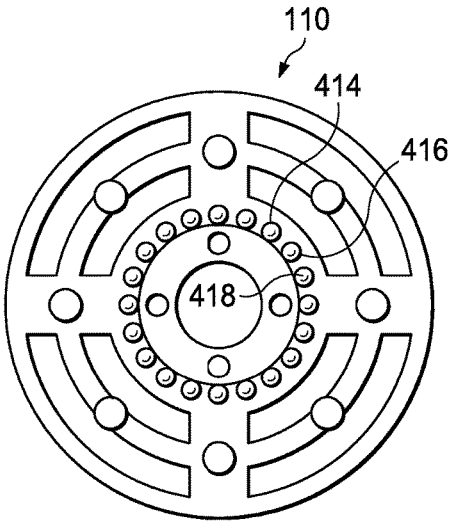

In some implementations, the isolation tool 110 can include an elastomer 408 that expands in response to being contacted with the hydrocarbons. For example, all or portions of some or all of the inner walls of the flow path 410 can be lined with the fast-acting elastomer 408. FIG. 4B is a top view of the isolation tool 110 showing the elastomer 408 positioned surrounding the cylindrical flow path 410. FIG. 4C is a top view of the isolation tool 110 showing bearings (e.g., a first ball bearing 414, a second ball bearing 416, a third ball bearing 418, and other bearings) that allow the inner housing 404 to rotate about an axis of the drill string 104.

Figure 4D:
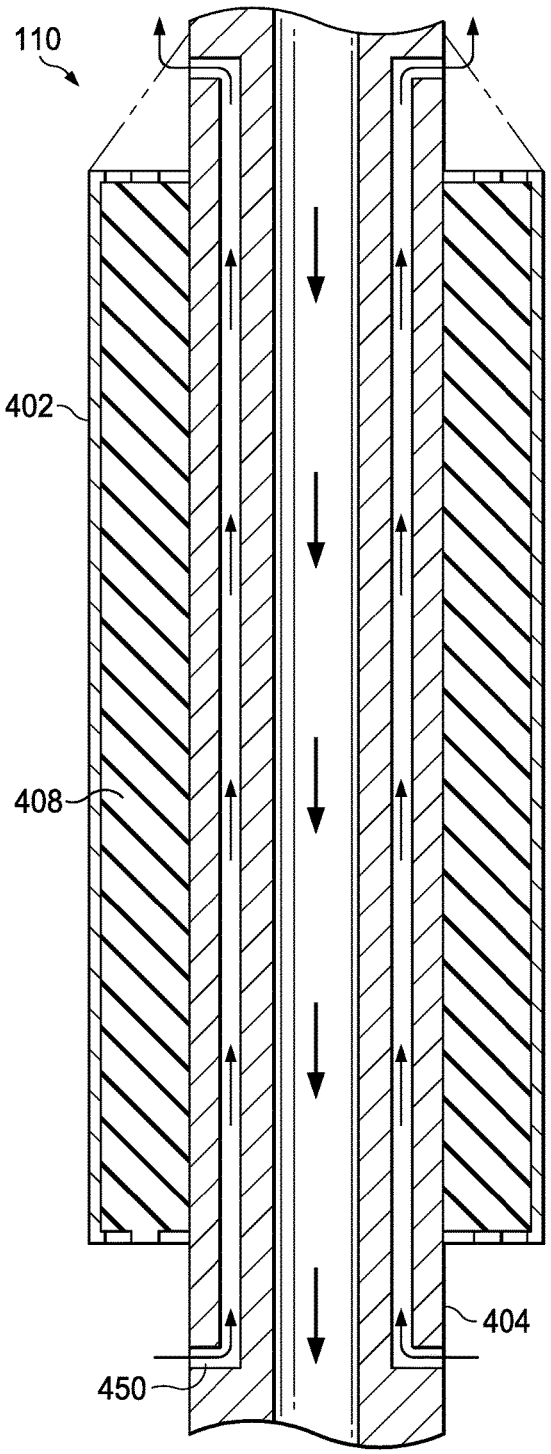
Figure 4E:
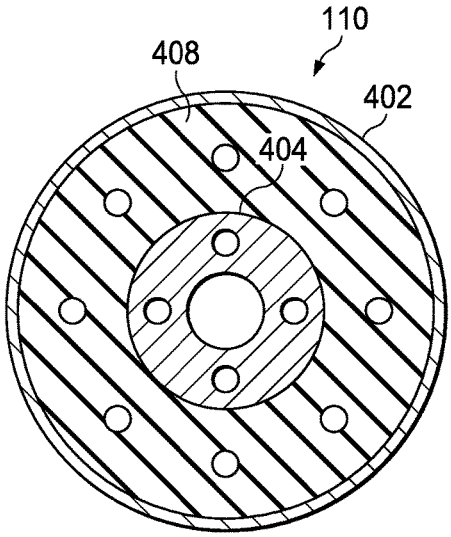

FIG. 4D is a cross-sectional view and FIG. 4E is a top-view of the isolation tool 110 in which the elastomer 408 has expanded to block flow. Hydrocarbons from the formation (e.g., oil or gas) influx into the wellbore due to drilling by the drill bit 106 and mix with the mixture of drilling mud and formation cuttings. The cutting grinder tool 102 pulverizes the formation cuttings in the mixture as described above. When the isolation tool 110 receives the mixture, which includes the drilling mud, pulverized formation cuttings, and the hydrocarbons, through the inlet portions 406, the hydrocarbons contact the elastomer 408. In response, the fast acting elastomer 408 swells to block the flow of the mixture through the isolation tool 110. The block in flow causes an increase in the hydraulic pressure of the mud pump at the surface that pumps the drilling fluid downhole. The increase in the pressure, which, in some situations, can be detected automatically by a monitoring system, can alert an operator of the drilling system 100 to take appropriate action.

In some implementations, the elastomer 408 can swell to block the entire flow of the mixture such that no portion of the mixture exits the isolation tool 110. In some implementations, the elastomer 408 can swell to block a portion of the flow of the mixture that is sufficient to increase the pressure of the mud pump to a threshold pressure. For example, the threshold pressure can be a pressure value that is sufficient to alert the operator of the drilling system 100 to take appropriate action.

In operation, the mixture of the drilling mud and the pulverized formation cuttings is flowed from the cutting grinder tool 102 to the inlet portions 406 by pressure created by the mud pump at the surface. The drilling mud flows through the flow path 410 and out of the outlet portions 416, and carries the pulverized formation cuttings toward the surface of the wellbore. If the mixture includes hydrocarbons, then the elastomer 408 expands upon being contacted by the hydrocarbons. The expanded elastomer 408 blocks (either partially or completely) the flow of the mixture of the drilling mud, the pulverized formation cuttings and the hydrocarbons to the surface. As described above, the block in flow results in an increase in the pressure of the mud pump at the surface, prompting action (manual or automatic), e.g., a stoppage of the wellbore drilling operation. In addition, the increase in pressure results in a pressure differential around the isolation tool 110. That is, the pressure above the isolation tool 110 can be less than the pressure below. In response to the flow path 410 being blocked, the inlet 414 to the bypass flow path 412 can be opened by a much higher surface mud pump pressure to force open the bypass flow path (as in FIGS. 7A-7C), as shown in FIG. 4D, to allow pressure equalization across the isolation tool 110. Such pressure equalization can, e.g., facilitate the safe retrieval of the BHA.

Figure 5A:
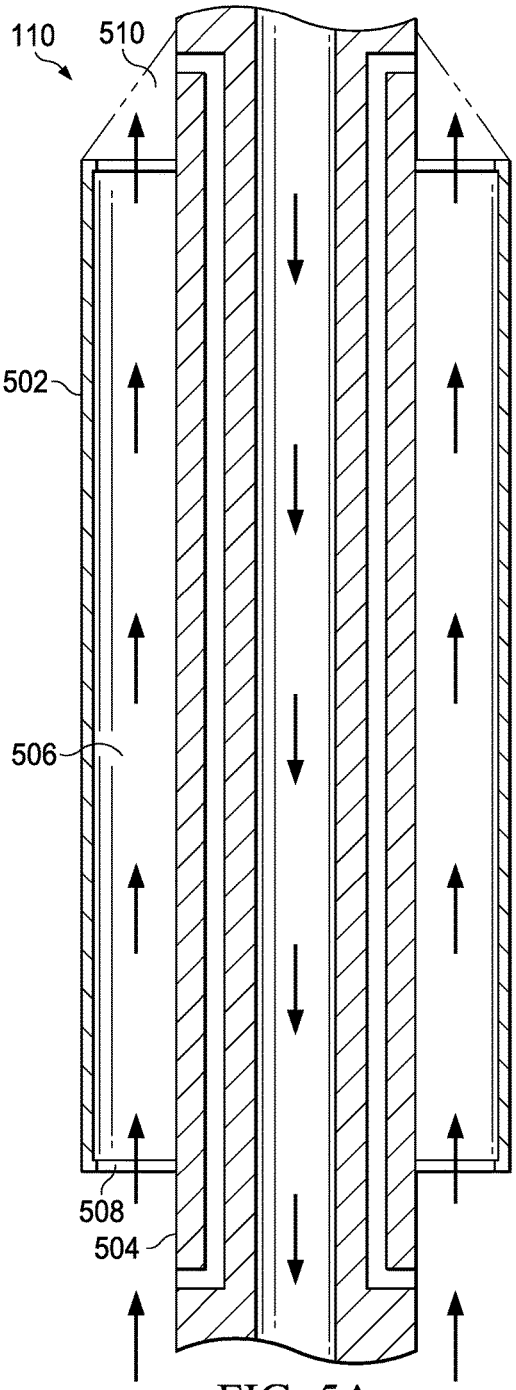
FIGS. 5A-5C are schematic diagrams showing different views of a second implementation of an isolation tool to isolate the wellbore drilling system.
Figure 5B:
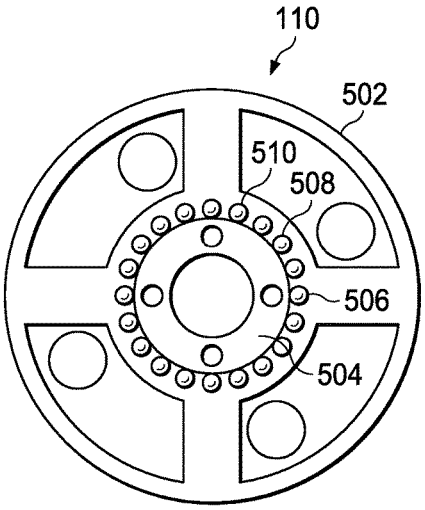
Figure 5C:
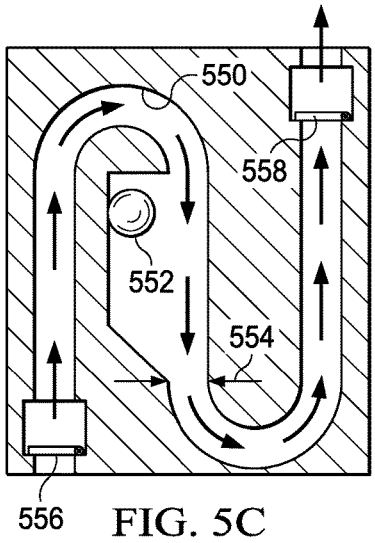

FIGS. 5A-5C are schematic diagrams showing different views of a second implementation of an isolation tool 110 to isolate the wellbore drilling system. In some implementations, the isolation tool 110 includes a stationary outer housing 502 and a rotary inner housing 504 that define inlet portions 508, a flow path 506 through which the mixture of the drilling mud and pulverized formation cuttings can flow through the isolation tool 110, and outlet portions 510 through which the mixture can exit the isolation tool 110 and flow to the surface of the wellbore. Similar to the first implementation of the isolation tool 110, an outer diameter of the isolation tool 110 is substantially the same as an outer diameter of the cutting grinder tool 102 surrounded by the stabilizer 119. For example, an outer diameter of the stationary outer housing 502 can be equal to the outer diameter of the stationary outer housing 302 surrounded by the stabilizer 119. For example, a nominal outer diameter of the second implementation of the isolation tool 110 is same as a nominal outer diameter of the cutting grinder tool 102. Because the isolation tool 110 is positioned immediately above the cutting grinder tool 102, the isolation tool 110 can divert nearly all of the mixture of the drilling mud and the pulverized formation cuttings into the flow path 508. Similar to the first implementation, the second implementation of the isolation tool 110 can also include a bypass flow path with an inlet that can be closed when the mixture flows through the isolation tool 110 and that can be opened in response to the flow path 506 being blocked. FIG. 5B is a top view of the second implementation of the isolation tool 110 showing bearings (e.g., a first ball bearing 509, a second ball bearing 511, and other bearings) that allow the inner housing 504 to rotate about an axis of the drill string 104.

FIG. 5C is a partial plane view showing features of the second implementation of the isolation tool 110 that blocks flow in response to an influx of hydrocarbons in the mixture of the drilling mud and the pulverized formation cuttings. The isolation tool 110 includes a flow path 550 that includes at least three sections—a first section in which the fluid flow is toward the surface, a second section connected to the first section in which the fluid flow is downhole, and a third section connected to the first section in which the fluid flow is toward the surface again. The isolation tool 110 includes a floating member having a density that is greater than a density of the mixture that includes the hydrocarbons and lesser than a density of the mixture that excludes the hydrocarbons. The flow path 550, e.g., the second section of the flow path, includes a seat 554 to receive the floating member in response to a change in the density of the fluid flowing through the flow path 550. For example, the floating member 552 can be a spherical ball that, as described below, can float above the seat 554, and, in the presence of hydrocarbons, descend in the second section to be received by the seat 554, thereby blocking flow.

Figure 6A:
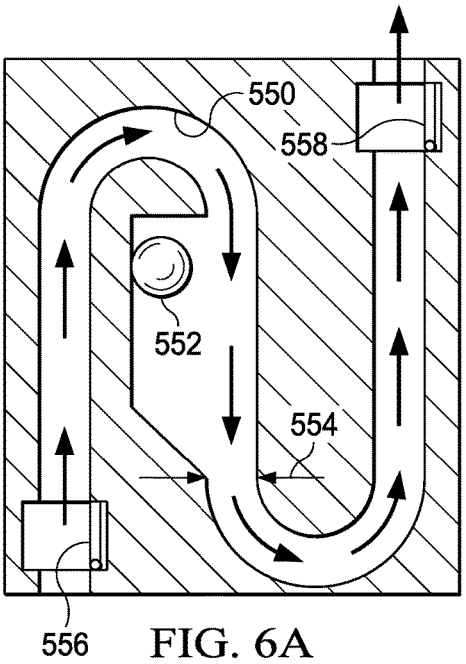
FIGS. 6A-6D are schematic diagrams showing operations performed by the isolation tool of FIGS. 5A-5C.

FIGS. 6A-6D are schematic diagrams showing operations performed by the isolation tool 110 of FIGS. 5A-5C. FIG. 6A is a schematic diagram showing the isolation tool 110 in an open state. In some implementations, the isolation tool 110 includes a first unidirectional flow valve 556 (e.g., a flapper valve or other unidirectional flow valve) at an inlet to the first section of the flow path 550. The first unidirectional flow valve 556 can be positioned at the inlet to the first section to open and remain open when the mixture of the drilling mud and the pulverized formation cuttings flows toward the surface. As the mixture flows into the second section of the flow path 550, the floating member 552, which is less dense than the mixture of the drilling mud and the pulverized formation cuttings, floats and ascends above the seat 554, to permit flow in a downhole direction through the second section. The mixture then flows into the third section of the flow path 550 toward the surface. The isolation tool includes a second unidirectional valve 558 (e.g., a flapper valve or other unidirectional flow valve) at an outlet to the third section of the flow path 550. The second unidirectional flow valve 556 can be positioned at the outlet to the third section to open and remain open when the mixture of the drilling mud and the pulverized formation cuttings flows toward the surface. In this manner, the isolation tool 110 permits flow of the mixture to the surface. The mixture contains no hydrocarbons or a quantity of hydrocarbons that is insufficient to cause the isolation tool 110 to block flow.

Figure 6B:
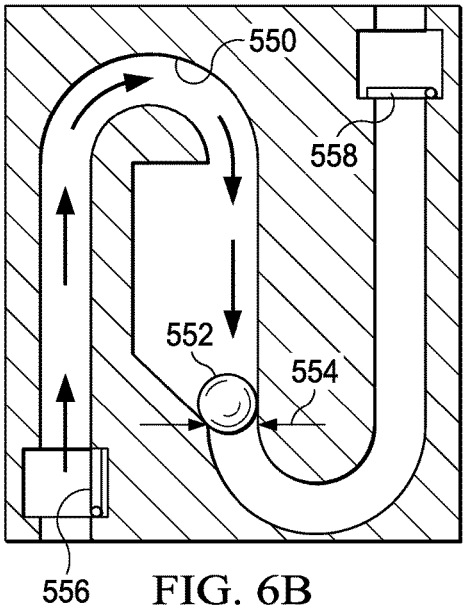

FIG. 6B is a schematic diagram showing the isolation tool 110 in a partially closed state. In FIG. 6B, hydrocarbons have influxed into the wellbore and been included in the mixture of the drilling mud and the pulverized formation cuttings. The first unidirectional valve 556 continues to remain open as the mixture that includes the drilling mud, the pulverized formation cuttings, and the hydrocarbons flows through the first section of the flow path 550 toward the surface. The density of mixture of the drilling mud and the pulverized formation cuttings, in the presence of the hydrocarbons, is less than the density of the mixture in the absence of the hydrocarbons. As a quantity of hydrocarbons in the mixture increases, the density of the mixture decreases to a valve that is less than the density of the floating member 552. In response to the density of the floating member 552 increasing to be greater than the density of the mixture of the drilling mud, the pulverized formation cuttings, and the hydrocarbons, the floating member 552 descends and is received by the seat 554, thereby blocking flow of the mixture, either completely or partially, from the second section to the third section. When the flow into the third section is blocked, the fluid pressure in the third section can decrease resulting in the second unidirectional valve 558 being closed.

Figure 6C:
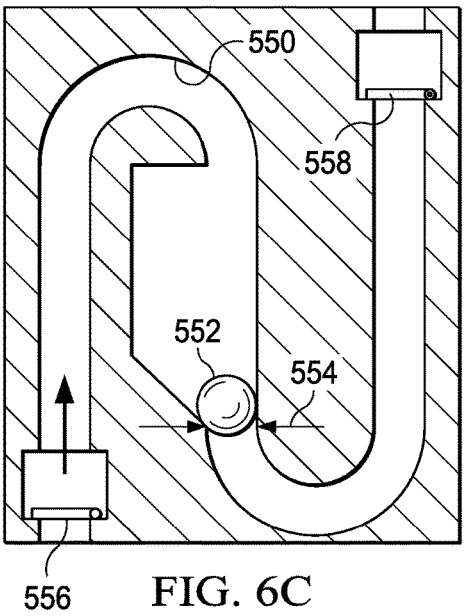

FIG. 6C is a schematic diagram showing the isolation tool 110 in a fully closed state. When the floating member 552 is received by the seat 554 and when the second unidirectional valve 558 closes, the pressure in all sections of the flow path 550 decrease. The decrease in pressure causes the first unidirectional valve 556 to also close resulting in the isolation tool 110 being in a fully closed state, and blocking flow, either partially or completely, to the surface. Similar to the first implementation of the isolation tool 110, the block in flow causes an increase in the hydraulic pressure of the mud pump at the surface that pumps the drilling fluid downhole. The increase in the pressure, which, in some situations, can be detected automatically by a monitoring system, can alert an operator of the drilling system 100 to take appropriate action, e.g., shut down drilling operations. Also, similar to the first implementation of the isolation tool 110, in response to the flow path being blocked, the inlet to the bypass flow path can be opened to allow pressure equalization across the isolation tool 110. Such pressure equalization can, e.g., facilitate the safe retrieval of the BHA. In some implementations, the isolation tool 110 can include both oil or gas swellable elastomer 408 described with reference to FIGS. 4A-4E and the floating member 552 described with reference to FIGS. 6A-6C.

Figure 6D:
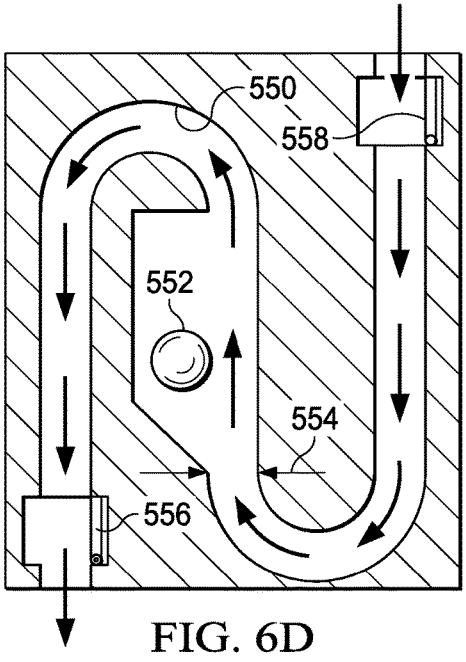

FIG. 6D is a schematic diagram showing flow reversal to remove the floating member 552 from the seat 554. The unidirectional flow valves may not be used in such a situation. Reversing the flow to flow downhole in the third section can cause the floating member 552 to be raised from the seat 554. The flow can continue toward the surface in the second section, and downhole in the first section. Such an arrangement can be implemented, e.g., to deal with false hydrocarbon influx because of trapped air during drill string installation.

Figure 7B:
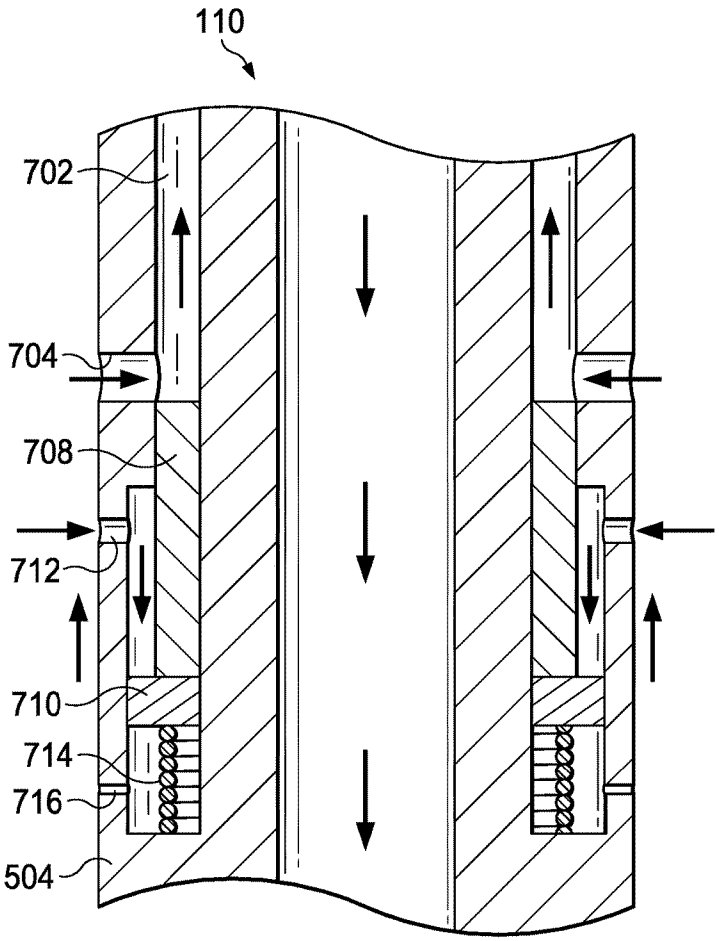
FIGS. 7A-7C are schematic diagrams showing bypass flow mechanisms implemented by the isolation tool.
Figure 7A:
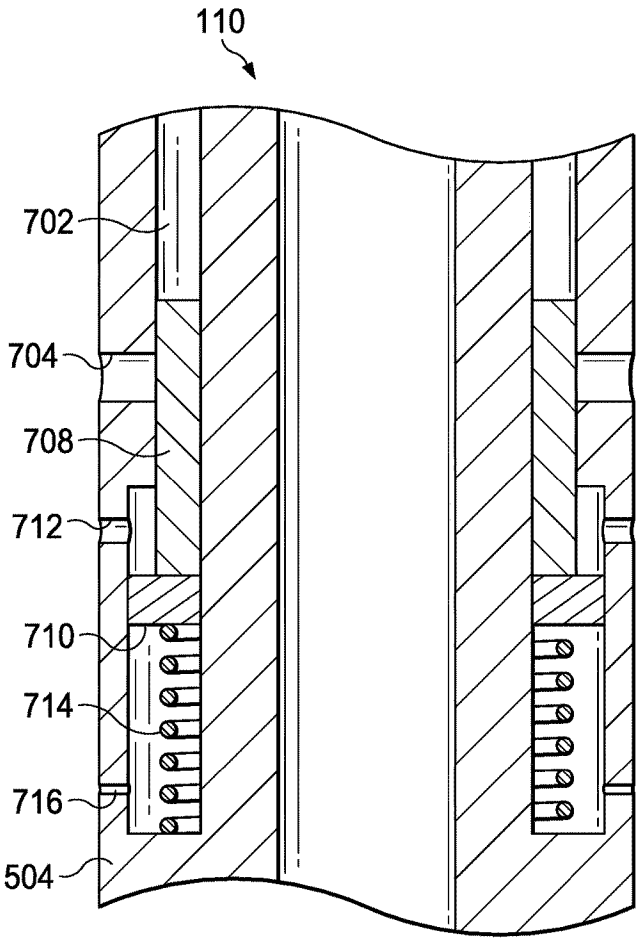
Figure 7C:
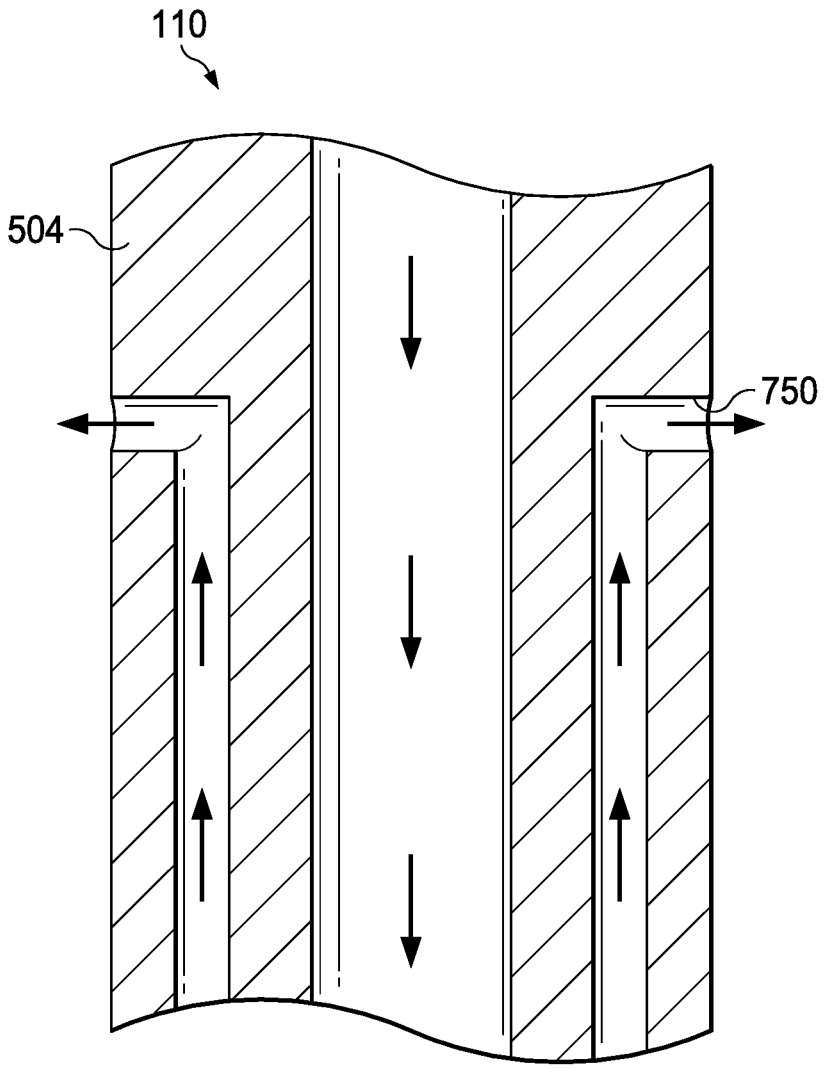

FIGS. 7A-7C are schematic diagrams showing bypass flow mechanisms implemented by the isolation tool 110. FIG. 7A is a cross-sectional view of a bottom portion of the isolation tool 110 including the bypass mechanism. The bypass mechanism includes the flow path 702 (e.g., the flow path 412 in FIG. 4A) having an inlet 704. When the bypass mechanism is not operated, e.g., for pressure equalization, a sleeve 708 (e.g., a sliding sleeve) covers the inlet 704 to the flow path 702. The sleeve 708 is connected to a piston head 710, which is in contact with a spring 714 (e.g., a biased power spring). The spring 714 is in a relaxed state when the flow path 702 is closed. The chamber in which the piston head 710 is positioned includes a pressure chamber 712 in a region near the piston head 710 and the sleeve 708 and a pressure vent 716 in a region near the spring 714.

FIG. 7B is a cross-sectional view of a bottom portion of the isolation tool 110 when the bypass mechanism is operated to permit flow. Pressure can be applied on the piston head 710 through the pressure chamber 712 causing the spring 714 to translate toward the bottom end of the bypass mechanism. In some implementations, the pressure applied on the piston head 710 can be from a large increase in the pressure of the drilling mud by the surface mud pump, the pulverized formation cuttings, and the hydrocarbons due to flow being blocked by the isolation tool 110. As the piston head 710 translates towards the bottom end of the bypass mechanism, the sleeve 708 also translates causing the inlet 704 to open and causing the spring 714 to be compressed. The mixture of the drilling mud, the pulverized formation cuttings, and the hydrocarbons enters the flow path 702 through the inlet 704, and flows toward the surface, thereby decreasing the pressure below the isolation tool 110. As the pressure decreases, the compressed spring 714 expands, applying a force on the piston 714 in the uphole direction. The uphole force on the piston 714 causes the sleeve 708 to close the inlet 704. Thus, the bypass mechanism automatically closes the flow path 702 upon pressure equalization. FIG. 7C is a cross-sectional view of a top portion of the isolation tool 110 including the bypass mechanism. The bypass mechanism includes a circulating port 750.

Figure 8:
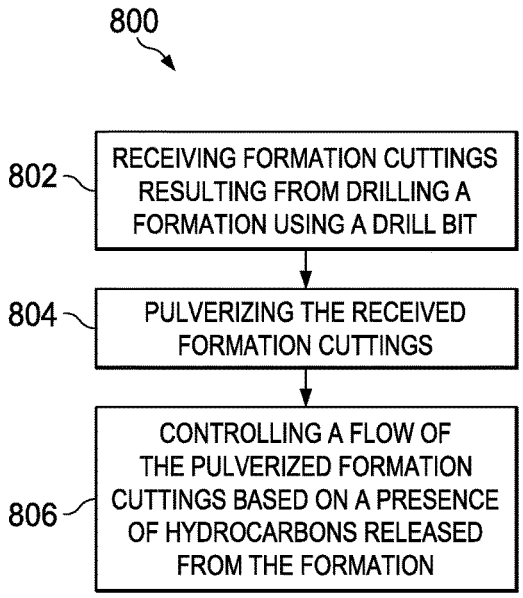
FIG. 8 is a flowchart of an example process implemented by the downhole self-isolating wellbore drilling system.

FIG. 8 is a flowchart of an example process 800 implemented by the downhole self-isolating wellbore drilling system. At 802, formation cuttings resulting from drilling a formation using a drill bit attached to a downhole end of the drill string are received, e.g., by the cutting grinder tool 102. The formation cuttings are mixed with drilling mud flowed through the drill string. At 804, the received formation cuttings are pulverized resulting in a mixture of pulverized formation cuttings and the drilling mud, e.g., by the cutting grinder tool 102. At 806, a flow of the mixture of the pulverized formation cuttings and the drilling mud is controlled based on a presence of hydrocarbons released from the formation in the mixture, e.g., by the isolation tool 110.

Figure 9:
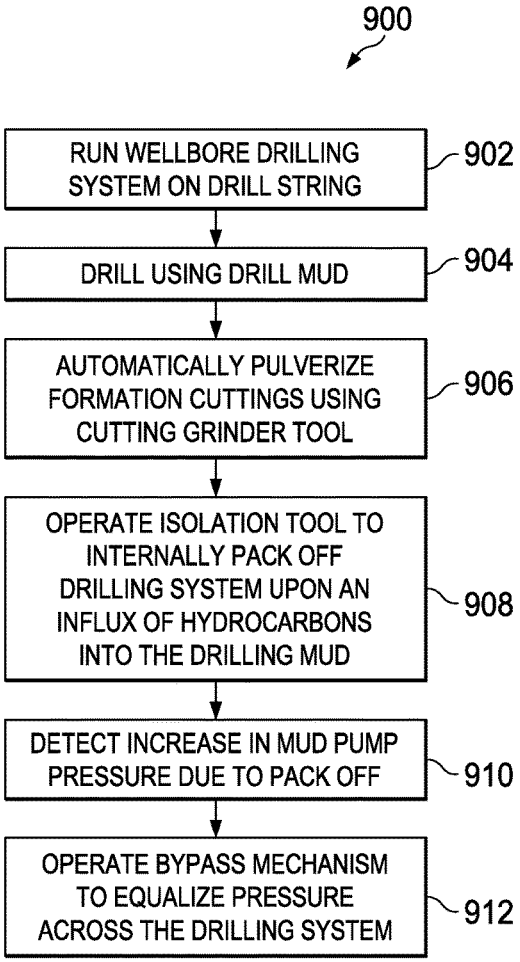
FIG. 9 is a flowchart of an example process for operating the downhole self-isolating wellbore drilling system.

FIG. 9 is a flowchart of an example process 900 for operating the downhole self-isolating wellbore drilling system. At 902, a drill string is run into a wellbore drilling system. At 904, the wellbore drilling system is implemented to drill the wellbore using drilling mud. At 906, the cutting grinder tool 102 is implemented to automatically pulverize formation cuttings. At 908, the isolation tool 110 is operated to internally pack off the wellbore drilling system upon an influx of hydrocarbons into the drilling mud. For example, in the event of encountering oil/gas influx, the isolation tool 110 will act as an isolation barrier, either by being packed-off internally by the expanding elastomer after a brief reaction time with the hydrocarbons or by the mechanical device with the density-sensitive floating member.

At 910, an increase in mud pump pressure due to pack off by the isolation tool is detected. In response, drilling operations can be stopped. In addition, for example, if surface flow check and additional return flow meter data indicate that the well is flowing, then the well can be immediately shut-in, i.e., by closing BOP ram, then by opening a circulation sub activated by pressure pulses to facilitate high volume circulation of higher mud weight through choke line to better control the well, and closing the circulation sub. At 912, the bypass mechanism is operated to equalize pressure across the drilling system. For example, pump pressure can be staged up to open the bypass flow channels to allow pressure equalization across the isolation tool 110, and then pumping can be continued to circulate the influx trapped below the isolation tool to surface. Then, the wellbore drilling tool system can be pumped out, e.g., to the previous casing shoe to avoid swabbing the well before pulling out of the wellbore.

A number of implementations have been described. Nevertheless, it will be understood that various modifications may be made without departing from the spirit and scope of the disclosure.

The invention claimed is:

1. A wellbore drilling system comprising:

a cutting grinder tool attached to a drill string uphole relative to a drill bit attached to a downhole end of the drill string, the cutting grinder tool to receive and pulverize formation cuttings resulting from drilling a formation using the drill bit; and an isolation tool attached to the drill string uphole relative to the cutting grinder tool, the isolation tool to control flow of a mixture of the pulverized formation cuttings mixed with a drilling mud through the drill string based on a change in a pressure of the mixture caused by a presence, in the mixture, of hydrocarbons released from the formation.

2. The system of claim 1, further comprising a mud motor positioned in the drill string between the cutting grinder tool and the isolation tool, the mud motor to vary a rotational speed of the drill bit.

3. The system of claim 1, wherein the isolation tool comprises a bypass mechanism defining a flow path through which the mixture is configured to flow; and a sleeve configured to close an inlet to the flow path in the absence of hydrocarbons in the mixture and to open the inlet to the flow path in the presence of hydrocarbons in the mixture.

4. The system of claim 3, wherein the isolation tool further comprises:

a piston head connected to the sleeve; and a spring connected to the piston head, the spring in a relaxed state when the inlet to the flow path is closed, the spring in a compressed state when the inlet to the flow path is open.

5. The system of claim 4, wherein the isolation tool further comprises:

a pressure chamber adjacent the piston head, the pressure chamber configured to receive at least a portion of the pressure of the mixture; and a pressure vent adjacent the spring.

6. The system of claim 4, wherein the piston head is configured to transfer the spring from the relaxed state to the compressed state based on an increase in the pressure of the mixture due to the presence of the hydrocarbons in the mixture, and to transfer the spring from the compressed state to the relaxed state based on a decrease in the pressure of the mixture due to the absence of the hydrocarbons in the mixture.

7. The system of claim 1, further comprising a stabilizer surrounding the cutting grinder tool, wherein an outer diameter of the cutting grinder tool surrounded by the stabilizer is substantially equal to an outer diameter of the drill bit, and wherein the cutting grinder tool is positioned over the drill bit to receive the formation cuttings.

8. The system of claim 7, wherein an outer diameter of the isolation tool is substantially equal to the outer diameter of the cutting grinder tool surrounded by the stabilizer, and wherein the isolation tool is positioned over the drill bit to receive the pulverized formation cuttings from the cutting grinder tool.

9. The system of claim 1, wherein the cutting grinder tool comprises:

a stationary outer housing and a rotating inner housing defining inlet portions to receive the formation cuttings; and grinding members connected to the rotating inner housing, the grinding members and the rotating inner housing to rotate to pulverize the formation cuttings received through the inlet portions.

10. A method comprising:

receiving formation cuttings resulting from drilling a formation using a drill bit attached to a downhole end of a drill string, the formation cuttings mixed with drilling mud flowed through the drill string;

pulverizing the received formation cuttings resulting in a mixture of pulverized formation cuttings and the drilling mud; and controlling a flow of the mixture of the pulverized formation cuttings and the drilling mud based on a change in a pressure of the mixture caused by a presence of hydrocarbons in the mixture.

11. The method of claim 10, wherein the pressure of the mixture increases responsive to the presence of the hydrocarbons and decreases responsive to an absence of the hydrocarbons, wherein controlling the flow of the mixture based on the presence of the hydrocarbons comprises:

opening a flow path to flow the mixture of the pulverized formation cuttings and the drilling mud in an uphole direction based on an increase in the pressure of the mixture; and closing the flow path based on a decrease in the pressure of the mixture.

12. The method of claim 11, wherein the flow path is closed by a sleeve connected to a spring, wherein opening the flow path to flow the mixture comprises compressing the spring, and wherein closing the flow path comprises relaxing the spring.

13. The method of claim 10, wherein pulverizing the received formation cuttings resulting in the mixture of pulverized formation cuttings and the drilling mud comprises:

receiving the formation cuttings in inlet portions defined by a stationary outer housing and a rotating inner housing of a cutting grinder tool attached to the drill string and positioned above the drill bit, the cutting grinder tool comprising grinding members connected to the rotating inner housing; and rotating the rotating inner housing to pulverize the formation cuttings received through the inlet portions.

14. The method of claim 10, further comprising flowing the mixture of the pulverized formation cuttings and the drilling mud from a cutting grinder tool that pulverizes the received formation cuttings to an isolation tool that controls the flow of the mixture.

15. A wellbore drilling system comprising:

a cutting grinder tool attached to a drill string above a drill bit attached to the drill string, the cutting grinder tool comprising:

a grinder tool outer housing and a grinder tool inner housing defining a cutting grinder tool inlet portion to receive formation cuttings resulting from drilling a formation using the drill bit; and grinding members positioned between the grinder tool outer housing and the grinder tool inner housing to pulverize the received formation cuttings; and an isolation tool attached to the drill string above the cutting grinder tool, the isolation tool comprising:

an isolation tool outer housing and an isolation tool inner housing defining an isolation tool inlet portion to receive a mixture comprising the formation cuttings pulverized by the cutting grinder tool and drilling mud; and a flow control system to control a flow of the mixture based on a change in a pressure of the mixture caused by a presence, in the mixture, of hydrocarbons released from the formation.

16. The system of claim 15, further comprising a stabilizer surrounding the grinder tool outer housing, wherein an outer diameter of the grinder tool outer housing surrounded by the stabilizer is substantially equal to an outer diameter of the drill bit to receive the formation cuttings carried by the drilling mud through the inlet portions.

17. The system of claim 15, wherein the grinder tool inner housing is rotatable, and wherein the grinding members are attached to the grinder tool inner housing to rotate to pulverize the formation cuttings.

18. The system of claim 15, wherein the flow control system comprises an elastomer to expand in the presence of hydrocarbons, and wherein the flow control system at least partially blocks the flow of the pulverized formation cuttings in the drilling mud in response to expansion of the elastomer.

19. The system of claim 15, wherein the flow control system comprises:

a floating member; and a seat to receive the floating member in response to a density of the floating member being greater than a density of the mixture including hydrocarbons, and wherein the flow control system at least partially blocks the flow of the pulverized formation cuttings in the drilling mud in response to the floating member being received in the seat.

* * * * *